US008091174B2

(12) United States Patent
Coburn et al.

(10) Patent No.: US 8,091,174 B2
(45) Date of Patent: Jan. 10, 2012

(54) UPRIGHT VACUUM CLEANERS

(75) Inventors: Eric Coburn, Coxhoe (GB); Barry Pears, Langley Moor (GB); Derek Muir, Daisy Hill (GB); Stephen Houghton, Newcastle Upon Tyne (GB)

(73) Assignee: Black & Decker Inc., Newark, DE (US)

( * ) Notice: Subject to any disclaimer, the term of this patent is extended or adjusted under 35 U.S.C. 154(b) by 225 days.

(21) Appl. No.: 12/434,182

(22) Filed: May 1, 2009

(65) Prior Publication Data

US 2009/0271941 A1 Nov. 5, 2009

(30) Foreign Application Priority Data

May 2, 2008 (EP) ..... 08155591

(51) Int. Cl.
*A47L 9/00* (2006.01)

(52) U.S. Cl. ..... 15/331; 15/334; 15/335; 15/327.2; 15/351; 15/353; 15/DIG. 1

(58) Field of Classification Search ..... 15/327.2, 15/350, 351, 353, 331–335; *A47L 9/00*
See application file for complete search history.

(56) References Cited

U.S. PATENT DOCUMENTS

| | | | | |
|---|---|---|---|---|
| 6,334,234 | B1 | 1/2002 | Conrad | |
| 7,213,297 | B2 * | 5/2007 | Nam et al. | 15/334 |
| 2006/0070205 | A1 | 4/2006 | Fischer | |

FOREIGN PATENT DOCUMENTS

| | | |
|---|---|---|
| DE | 3716104 | 11/1988 |
| DE | 19915881 | 10/2000 |
| GB | 2402048 | 12/2004 |
| GB | 2423466 | 8/2006 |
| WO | 2008037955 | 4/2008 |

* cited by examiner

*Primary Examiner* — David Redding
(74) *Attorney, Agent, or Firm* — John Yun

(57) ABSTRACT

The present invention provides an upright vacuum cleaner (10) having an elongate body (12) and comprising a floorhead (14) on which the elongate body is mounted, the floorhead (14) having a first inlet (140) for dirty air, a wand having a second inlet for dirty air, a changeover valve (22) for selecting between a flow of dirty air from the first or second inlet, a dust collection chamber (18) also having a dirty air inlet (180), a duct (28) for conveying said flow of dirty air from the changeover valve (22) to the dust collection chamber inlet (180), and a source of suction power for drawing the dirty air from the first or second inlet through said changeover valve (22) and said duct (28) to the dust collection chamber inlet (180). The changeover valve (22) comprises a linear conduit (24) positionable in fluid flow between the first inlet (140) for dirty air of the floorhead (14) and said duct (28), the duct (28) having a sigmoid curve (30) from the changeover valve (22) to the dust collection chamber inlet (180). When the conduit (24) is positioned in fluid flow between the first inlet (140) and the duct (28), the flow of dirty air from the first inlet (140), through the changeover valve (22) and the duct (28) to the dust collection chamber inlet (180) all lies in a plane.

12 Claims, 10 Drawing Sheets

UPRIGHT VACUUM CLEANERS

CROSS-REFERENCE TO RELATED APPLICATION

This application claims priority to EP Patent Application No. 08 155 591.4 filed May 2, 2008. The entire contents of that application are expressly incorporated herein by reference thereto.

FIELD OF THE INVENTION

The present invention concerns upright vacuum cleaners. Such a type of vacuum cleaner has been known for many years, and is distinguished from other types of vacuum cleaners, such as cylinder vacuum cleaners and hand-held vacuum cleaners, by having a generally elongate body mounted on top of a floorhead, with a handle located at an upper end of said body, dirty air being drawn into the vacuum cleaner during operation thereof through a dirty air inlet located in the floorhead, and transmitted via a duct into the body of the vacuum cleaner, where dust and dirt are separated out from the dirty air, before clean air is expelled through a clean air outlet of the vacuum cleaner to atmosphere. In such a vacuum cleaner, the elongate body is pivotable between a substantially vertical position, in which the vacuum cleaner may be parked and stored, and a tilted or even horizontal position, in which a user may hold the handle and push or pull the body of the vacuum cleaner around, so that the floorhead passes over a surface to be cleaned and draws in dirty air therefrom. Means for separating out dust and dirt from the dirty air is typically located within the body of the vacuum cleaner and may be some type of filter, such as a bag or fabric filter, or a cyclonic separation device, which uses centrifugal force to fling dust and dirt outwardly from the incoming flow of dirty air, or a combination of both. Upright vacuum cleaners which use a plurality of means for separating out dust and dirt from the dirty air arranged in sequence are also known. In any case, however, the vacuum cleaner will also comprise a dust collection chamber for collecting dust and dirt separated out from the incoming dirty air.

BACKGROUND OF THE INVENTION

It is also well known that the effectiveness of an upright vacuum cleaner in collecting dust and dirt from a surface to be cleaned (called the "pick-up ratio" of the vacuum cleaner) depends in part on both the pressure difference, or "suction", and on the airflow, as measured in volume of air moved per unit time, which are achieved at the dirty air inlet of the floorhead, although the pick-up ratio may also be improved, for example, by including a rotating brush in the floorhead to dislodge dust and dirt from the surface to be cleaned. Both the pressure difference and the airflow are themselves in turn both dependent on two things, namely the power of a source of suction which the vacuum cleaner comprises and the efficiency of the design of the vacuum cleaner in transmitting that power to the dirty air inlet of the floorhead. These relationships may best be understood by reference to the accompanying FIG. 1.

As may be seen in FIG. 1, maximum suction and therefore peak pressure difference between the dirty air inlet of the floorhead and atmospheric air is achieved when the dirty air inlet is completely occluded, whereas at this point, the airflow is of course also at a minimum. On the other hand, peak airflow through the dirty air inlet is achieved when the dirty air inlet is completely unobstructed, whereas at this point, the pressure difference drops to a minimum instead. Under normal operating conditions, the actual pressure difference and airflow will lie somewhere between these two extremes. The mathematical product of the pressure and the airflow gives a value known as the air watts, which measures the suction power of the dirty air inlet. The peak air watts are achieved somewhere between the points of peak pressure and peak airflow, at a point where this mathematical product is maximised. The efficiency of the design of the vacuum cleaner may then easily be measured as the ratio of these peak air watts achieved divided by the number of watts of electrical power supplied to the source of suction which the vacuum cleaner contains, which is typically a fan driven by an electrical motor. Thus, in order to increase the value of the peak air watts achieved, and therefore the effectiveness of the vacuum cleaner (the "pick-up ratio"), either the power of the vacuum cleaner's source of suction or the efficiency of the vacuum cleaner's design must be improved.

Increasing the power of the vacuum cleaner's source of suction has two disadvantages. Firstly, it entails increasing both the size and the weight of the source of suction. Secondly, it also increases the vacuum cleaner's power consumption. In the case of a mains powered vacuum cleaner, this has the effects of increasing the running costs and the environmental impact of the vacuum cleaner. However, in the case of a battery powered vacuum cleaner, it is particularly disadvantageous, because apart from increasing the running costs and the environmental impact of the vacuum cleaner, it also increases the size and weight of whatever battery the vacuum cleaner also comprises to supply electrical power to the source of suction. Therefore, it is more desirable to try and improve the efficiency of the vacuum cleaner's design than to increase the power of the vacuum cleaner's source of suction, and this fact is most particularly true in the case of a battery powered or cordless vacuum cleaner.

One prior art document which addresses this problem of how to improve the efficiency of design of an upright vacuum cleaner is U.S. Pat. No. 6,334,234 in the name of Conrad et al. This document describes an upright vacuum cleaner comprising a floorhead having an inlet for dirty air, an elongate body comprising a dust collection chamber and having a handle located at an upper end of said body, a duct for conveying dirty air from the inlet to the dust collection chamber, and a source of suction power for drawing dirty air from said inlet, through said duct to said dust collection chamber, wherein the dust collection chamber comprises a cyclonic separation device. According to this document, a bend in a conduit for a fluid causes a turbulent pressure loss in the conduit as the fluid travels through the bend in the conduit and the greater the sharpness of the bend, the greater the pressure loss. The pressure loss in the airflow decreases the amount of suction which can be generated at the cleaning head of the vacuum cleaner for any given motor in the vacuum cleaner and therefore the efficiency of the vacuum cleaner (column 2, lines 12 to 19). This document aims to solve this problem by positioning a motor for generating an airflow through the vacuum cleaner above the cyclonic separation device when the elongate body of the vacuum cleaner is pivoted to be generally vertical. Thus the path of clean air from the cyclonic separation device to the source of suction of which the motor is part is short and straight, and the efficiency of the upright vacuum cleaner is thereby improved.

However, it should also be mentioned in this context that the idea of placing a motor at the top of an upright vacuum cleaner above the dust collection chamber when the elongate body of the vacuum cleaner is pivoted to be generally vertical is already known from earlier European patent no. 0 439 273

B. This earlier document describes a battery-powered upright vacuum cleaner comprising a floorhead having an inlet for dirty air, an elongate body having a handle located at an upper end thereof the body housing a dust collection chamber comprising a filter bag, a duct for conveying dirty air from the inlet of the floorhead to the dust collection chamber, and a source of suction power for drawing dirty air from the inlet, through the duct to the dust collection chamber, wherein the source of suction power comprises a motor and a fan located above the dust collection chamber.

U.S. Pat. No. 6,334,234 also discloses that the upright vacuum cleaner described therein may comprise a wand having a second dirty air inlet additional to the dirty air inlet of the floorhead, the wand being for a user to perform above-floor cleaning, and a changeover valve allowing the flow of dirty air entering the dust collection chamber to be selected between the respective dirty air inlets of the floorhead and the wand, although this document gives no further details of the changeover valve, apart from stating that suitable valve means are known in the art (column 8, lines 24 to 26). Although not described in this document either, an upright vacuum cleaner made according to the teachings of this document and sold in the North American market under the Westinghouse brand, also comprises a battery for supplying electrical power to the source of suction power.

In the vacuum cleaner described in U.S. Pat. No. 6,334,234, however, the airflow pathway from the floorhead to the dust collection chamber comprises at least one sharp, right-angled bend to one side, and in some of the embodiments disclosed therein, a further bend from the duct to the inlet of the dust collection chamber, which is contrary to the teachings of this document described above that such bends should be avoided. Moreover, in the embodiment described as also comprising a changeover valve, it is not known whether this changeover valve may also introduce further contortions into the airflow pathway, thereby also affecting the efficiency of the vacuum cleaner adversely.

An object of the present invention, therefore, is to provide an improved upright vacuum cleaner, which addresses the problems inherent in the design of the vacuum cleaner described in U.S. Pat. No. 6,334,234. Another object of the present invention is to provide an upright vacuum cleaner with improved efficiency, which is particularly suitable for use with battery power.

BRIEF SUMMARY OF THE INVENTION

Accordingly, the present invention provides an upright vacuum cleaner having an elongate body and comprising a floorhead on which the elongate body is mounted, the floorhead having a first inlet for dirty air, a wand having a second inlet for dirty air, a changeover valve for selecting between a flow of dirty air from the first or second inlets, a dust collection chamber also having a dirty air inlets a duct for conveying the dirty air from the changeover valve to the inlet of the dust collection chamber, and a source of suction power for drawing the dirty air from one of the inlets through the changeover valve and the duct to the inlet of the dust collection chamber. The changeover valve has a linear conduit positionable in fluid flow between the first inlet for dirty air of the floorhead and the duct, the duct comprising a sigmoid curve from the changeover valve to the inlet of the dust collection chamber. When the conduit is positioned in fluid flow between the first inlet and the duct, the flow of dirty air from the first inlet through the changeover valve and the duct to the inlet of the dust collection chamber all lies in a plane.

This combination of features has the advantage of ensuring that the flow of dirty air from the floorhead does not encounter any sharp bends or sudden changes of direction as it passes through the changeover valve and the duct to the inlet of the dust collection chamber, but rather passes in a line which, when the body of the vacuum cleaner is in its tilted, use position, is as close to a straight line as is possible. In particular, the sigmoid curve of the duct also ensures that the flow of dirty air is directed into the inlet of the dust collection chamber in as smooth a manner as possible by directing the dirty air outwardly, away from the dust collection chamber in the first bend of the sigmoid curve, before it is then directed into the dust collection chamber by the second bend of the sigmoid curve on a larger radius than would otherwise be the case if only a single bend were used to direct the flow of dirty air into the inlet of the dust collection chamber from the duct. Thus, by a sigmoid curve in this context is meant a curve having a first bend in a first direction and then a second bend in a second direction opposite to the first direction. Such a curve could therefore also be described as being somewhat in the shape of a question mark.

In a preferred embodiment, the dust collection chamber comprises a cyclonic separation device and the plane is made tangential to an outer surface of the cyclonic separation device, so that the flow of dirty air from the duct enters the inlet to the dust collection chamber, and hence the cyclonic separation device, tangentially. This ensures that the flow of dirty air may also enter the cyclonic separation device tangentially, which is the optimal configuration for cyclonic separation, without the need for any further bends or turns to be incorporated into the airflow pathway. This is in contrast to the vacuum cleaner described in U.S. Pat. No. 6,334,234, which states that the duct from the floorhead to the dust collection chamber therein should preferably enter the dust collection chamber through the bottom thereof (see column 5, lines 66 to 67 and FIG. 7). The improved preferred configuration of the present invention also means that if the cyclonic separation device is located centrally about a longitudinal axis of the elongate body of the vacuum cleaner, the plane is offset from that longitudinal axis, which makes the vacuum cleaner body more compact.

Preferably, the source of suction power comprises a motor and a fan located above the dust collection chamber when the elongate body of the vacuum cleaner is pivoted to a substantially vertical position. This has the advantages already described above and recognized in U.S. Pat. No. 6,334,234.

In a preferred embodiment, the vacuum cleaner further comprises a compartment for receiving a battery for supplying electrical power to the motor, the battery compartment being located beneath the dust collection chamber when the elongate body of the vacuum cleaner is pivoted to a substantially vertical position. This has the advantage that when a battery is located in the battery compartment, the weight of the battery at the bottom of the vacuum cleaner helps to balance out the weight of the motor and fan in the event that these latter two are located above the dust collection chamber, thereby lowering the centre of gravity of the vacuum cleaner and making it easier to manoeuvre and use. This is in contrast to the Westinghouse unit described above, in which a battery is located above the dust collection chamber, along with the motor and fan, making the unit quite top-heavy.

On the other hand, the location of the battery or of the motor, in the event that either of them are located beneath the dust collection chamber should not interfere with the flow of dirty air from the first inlet of the floorhead to the inlet of the dust collection chamber. For example, in a known upright vacuum cleaner manufactured and sold by Dyson, the motor and the changeover valve are both located beneath the dust collection chamber alongside one another, but as a result, the flow of dirty air from the inlet of the floorhead to the inlet of the dust collection chamber has to deviate around the motor through the changeover valve, thereby introducing additional sharp bends into the airflow pathway. Accordingly, it is desirable that the battery compartment in the present invention should preferably be located either fore or aft of the changeover valve, lying across the plane containing the flow of dirty air from the first inlet of the floorhead, through the changeover valve and the duct to the inlet of the dust collection chamber, and more preferably still that the battery compartment should be located in front of the changeover valve inside a curve defined by the flow of dirty air from the inlet of the floorhead through the changeover valve to the duct. In this latter case, the vacuum cleaner can be made as compact as possible without disrupting the smooth flow of dirty air from the inlet of the floorhead to the inlet of the dust collection chamber.

Preferably, the vacuum cleaner further comprises a battery and the battery compartment is oriented at an oblique angle to a longitudinal axis of the elongate body of the vacuum cleaner, the battery comprising a handle located at an end thereof, thereby allowing a user to insert the battery into and remove the battery from the battery compartment by means of its handle. This has the advantage that although the battery is located beneath the dust collection chamber of the vacuum cleaner, the handle is then easily accessible to a user, such that the user may remove and replace the battery, for example for recharging, with little effort.

In a particularly preferred embodiment of the invention, the changeover valve further comprises a J-shaped conduit positionable in fluid flow between the second inlet for dirty air of said wand and said duct. Thus, when the J-shaped conduit is placed in fluid flow between the second inlet for dirty air of the wand and the duct, the flow of dirty air from an outlet of the wand, through the changeover valve and the duct to the inlet of the dust collection chamber passes through only a single additional obtuse bend, formed by the J-shaped conduit, thereby maintaining the efficiency of the vacuum cleaner even during use of the wand.

it is also preferable that the overall length of the airflow pathway from the first inlet for dirty air of the floorhead to the inlet of the dust collection chamber, when the linear conduit of the changeover valve is positioned in fluid flow between the first inlet and the duct, should lie in the range of between 600 mm and 1000 mm. It is found experimentally that a length lying in this range gives the highest air watts and hence the best overall system efficiency for the vacuum cleaner. Surprisingly, and contrary to expectations, an airflow pathway shorter than about 600 mm gives reduced air watts and hence a lesser system efficiency, even though the dirty air has to travel a shorter distance. It is believed that this is because a slightly longer overall length allows the flow of dirty air entering the duct to re-acquire laminar flow after it has passed through the curve from the inlet of the floorhead through the changeover valve to the duct, which curve is created by putting the vacuum cleaner in its tilted, use position and which tends to introduce turbulence into the air, before the dirty air then encounters the sigmoid curve of the duct which redirects the dirty air to the inlet of the dust collection chamber. On the other hand, an airflow pathway longer than about 1000 mm also gives reduced air watts and hence a lesser system efficiency because the increased distance the dirty air has to travel necessarily increases the friction of the airflow pathway on the air passing through it. Moreover, an airflow pathway longer than about 1000 mm makes the vacuum cleaner too tall for an averagely sized human to use with comfort and ease. Thus an overall length between about 600 mm and 800 mm is most preferred.

In order to pivot the elongate body of the vacuum cleaner between its substantially vertical position, in which the vacuum cleaner may be parked and stored, and a tilted or even horizontal position, in which the vacuum cleaner may be used for cleaning, the vacuum cleaner should further comprise a pivot joint located in fluid flow between the first inlet for dirty air of the floorhead and the changeover valve. This pivot joint may comprise a plurality of rigid components arranged to move between a first position, in which they adopt a substantially right-angled configuration corresponding to the vertical, parked position of the vacuum cleaner body, and a second position, in which they adopt a smoothly curving configuration corresponding to the tilted, use position of the vacuum cleaner body. However, it has been found that pivot joints of this type which are composed of a plurality of rigid components are prone to leakage of air through the joints between the components, therefore affecting the efficiency of the vacuum cleaner during use. Preferably, therefore, the pivot joint should instead comprise a flexible hose of the type represented by reference numeral 46 in FIG. 3 of EP 0 439 273 B. On the other hand, such a flexible hose should be kept as short as possible for the following reason. When the vacuum cleaner is pivoted from its vertical, parked position to its tilted, use position, the flexible hose contracts, because the distance from the first inlet for dirty air of the floorhead to the changeover valve is reduced. However, although the length of the flexible hose is therefore shorter in the tilted, use position than in the vertical, parked position of the vacuum cleaner, it is also both narrower and less smooth, which have the combined effect of constricting the flow of dirty air therethrough. This is because the flexible hose is typically composed of a resilient spiral metal coil supporting a tube made of an inelastic plastics material. Thus, when the flexible hose contracts, the spiral metal coil relaxes and the inelastic tube it supports becomes folded between successive turns of the spiral. These folds reduce the inner diameter of the tube and also introduce corrugations into the interior surface thereof. It is therefore preferable that the flexible hose should comprise no more than about 20% of the overall length of the airflow pathway between the first inlet for dirty air of the floorhead and the inlet of the dust collection chamber, so that these deleterious effects may be minimized.

BRIEF DESCRIPTION OF THE INVENTION

Further features and advantages of the present invention will be better understood from the followed detailed description, which is given by way of example and in association with the accompanying drawings, in which.

DETAILED DESCRIPTION OF THE INVENTION

Figure 1:
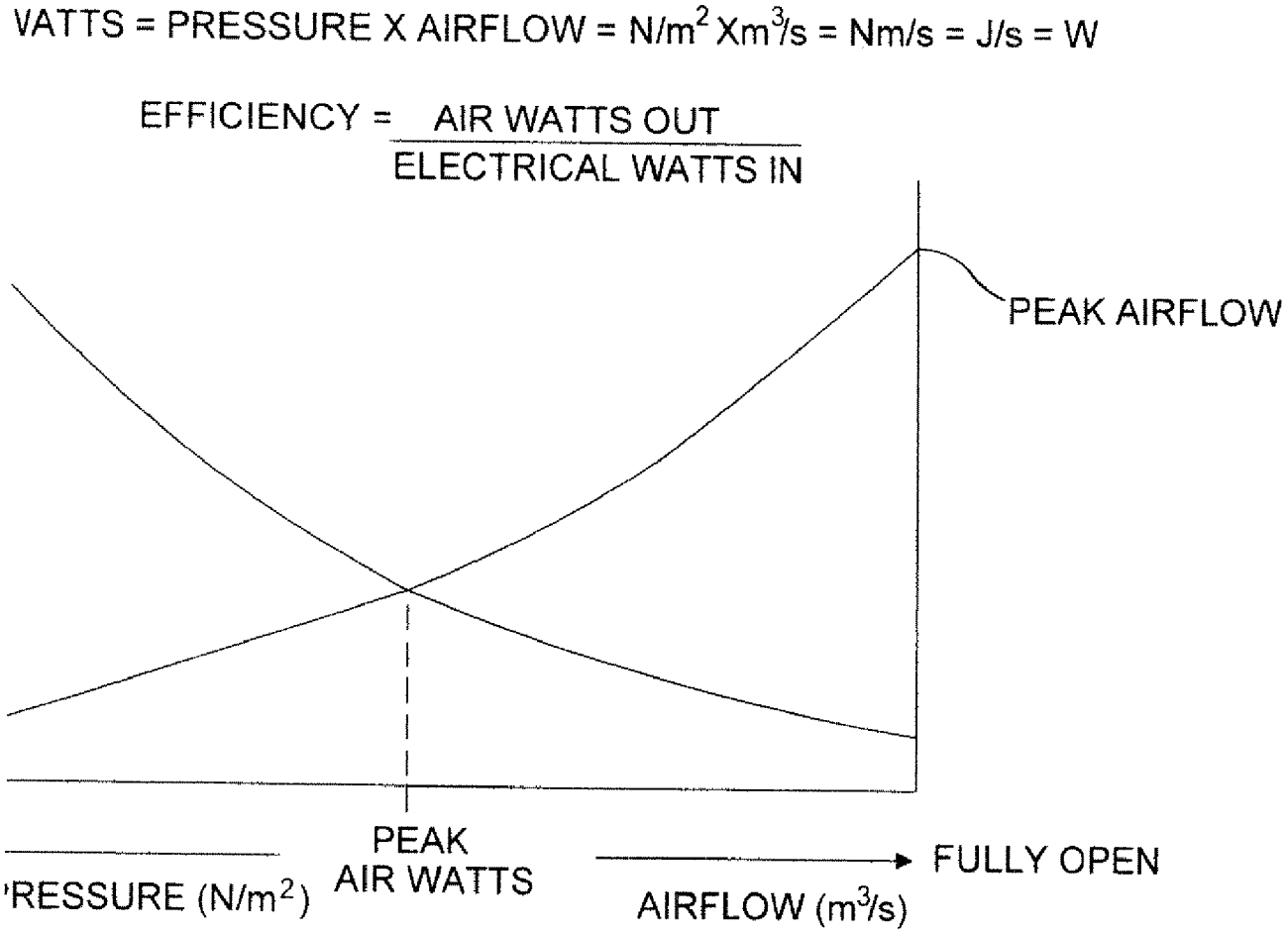
FIG. 1 (PRIOR ART)
FIG. 1 is a graph showing the relationship between pressure and airflow on the one hand and degree of occlusion of a dirty air inlet to a vacuum cleaner, and their combined influence on the efficiency of the vacuum cleaner.
Figure 2:
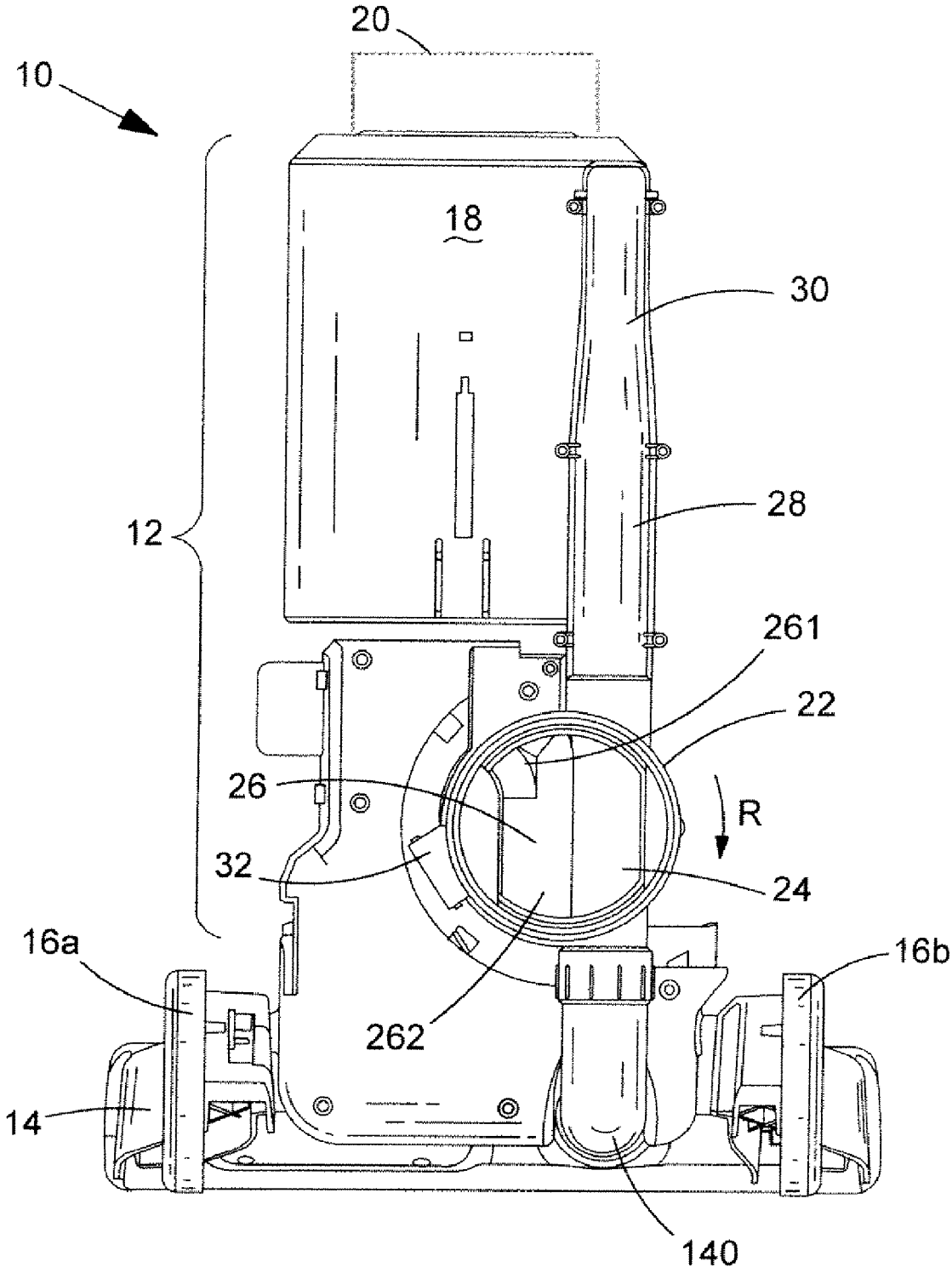
FIG. 2 is a rear elevational view of an upright vacuum cleaner according to an embodiment of the invention in a substantially vertical, parked position.

Referring firstly to FIG. 2, there is shown an upright vacuum cleaner 10 according to an embodiment of the invention in a substantially vertical, parked position thereof. The vacuum cleaner comprises an elongate body 12 and a floorhead 14 on which the elongate body is mounted. The floorhead has a dirty air inlet 140 and is provided with a pair of wheels 16*a*, 16*b* to allow a user to move the floorhead of the vacuum cleaner with ease over a surface to be cleaned. The elongate body 12 comprises a dust collection chamber 18 on which is mounted a motor and a fan, generally shown as 20 (not shown subsequent drawings), which together provide a source of suction power for drawing a flow of dirty air from the dirty air inlet 140 into the dust collection chamber 18. In this and subsequent drawings, a handle which is located at an upper end of the elongate body 12 has also been omitted, since it does not form an essential element of the invention. However, such a handle should be understood as always being present and may be either rigidly attached to the elongate body 12 or foldable in order to reduce the overall size of the vacuum cleaner for storage in a cupboard or closet. Other non-essential features of the invention also present in the vacuum cleaner of this embodiment, such as the electrical components thereof, have also been omitted from this and subsequent drawings for greater clarity.

FIG. 2 also shows, however, that the vacuum cleaner 10 comprises a changeover valve 22, from which a rear cover has been removed in this drawing, so that the inner components of the valve may be clearly seen. Thus, changeover valve 22 comprises a first, linear conduit 24 for receiving a flow of dirty air from the dirty air inlet 140 of floorhead 14 and a second, J-shaped conduit 26 for receiving a flow of dirty air from the dirty air inlet of a wand of the vacuum cleaner, as will be described shortly. Linear conduit 24 and J-shaped conduit 26 are mounted side-by-side within a housing of changeover valve 22 and can co-rotate with one another in a direction indicated in FIG. 2 by arrow R. Above changeover valve 22 is located a duct 28 for conveying the flow of dirty air from the changeover valve 22 to an inlet 180 (for which see FIG. 3) of the dust collection chamber 18. The duct 28 comprises a sigmoid curve 30 from the changeover valve 22 to the inlet 180 of the dust collection chamber 18, which will be more clearly visible in subsequent drawings. in FIG. 2, linear conduit 24 is shown positioned in fluid flow between the dirty air inlet 140 of floorhead 14 and duct 28 so that dirty air is conveyed from the dirty air inlet 140, through the linear conduit 24 of changeover valve 22 and duct 28 to the inlet 180 of dust collection chamber 18. As can be seen clearly from FIG. 2, the dirty air inlet 140, the linear conduit 24 and the duct 28, including the sigmoid curve 30 thereof all lie in one plane. However, when changeover valve 22 is rotated in the direction of arrow R by approximately 45 degrees, a first end 261 of 4-shaped conduit 26 is aligned with duct 28 and a second end 262 of J-shaped conduit 26 is aligned with an outlet 32 from the wand, and J-shaped conduit 26 is positioned in fluid flow between the wand outlet 32 and duct 28 instead of linear conduit 24. On the other hand, co-rotating the two conduits 24, 26 of changeover valve 22 back approximately 45 degrees against the direction of arrow R returns linear conduit 24 back into fluid flow between floorhead 14 and duct 28 again.

Figure 3:
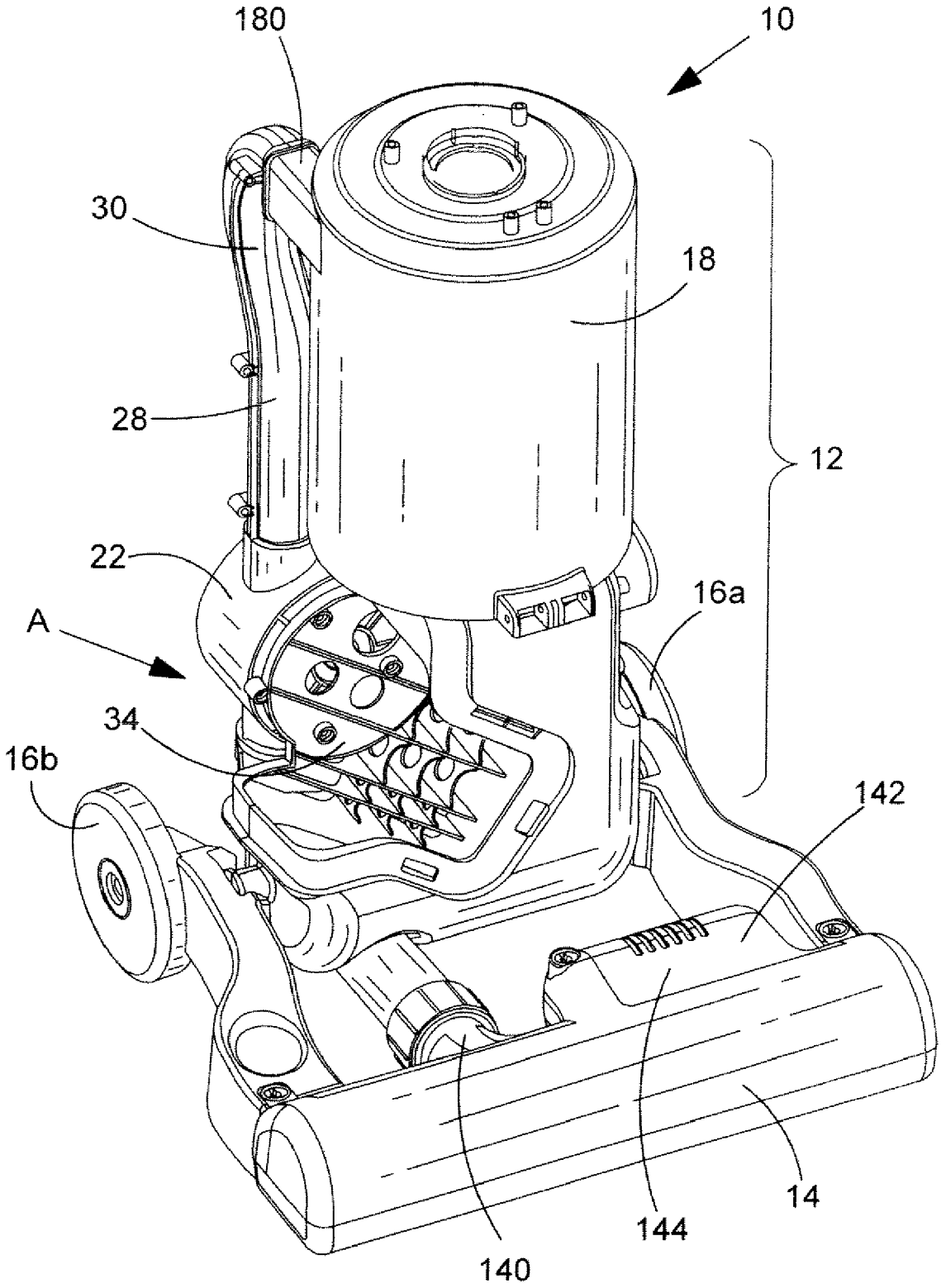
FIG. 3 is a front perspective view of the vacuum cleaner of FIG. 2, again shown in a substantially vertical, parked position.

Turning to FIG. 3, several components of the vacuum cleaner described above in relation to FIG. 2 may now be seen more clearly. In particular, the shape of sigmoid curve 30 of duct 28 may be seen more clearly, as may the inlet 180 of dust collection chamber 18 and the disposition of dirty air inlet 140 in floorhead 14. It may also be seen that floorhead 14 further comprises a compartment 142 which contains an auxiliary motor for driving a rotatable brush contained within floorhead 14. Compartment 142 is itself provided with air vents 144 to allow this auxiliary motor to be cooled by atmospheric air. The rotatable brush is provided within floorhead 14 in order to improve the pick-up ratio of the vacuum cleaner by dislodging dust and dirt from a surface to be cleaned. Most visible in FIG. 3, however, is a compartment 34 for receiving a removable battery (not shown) for supplying electrical power to the motor of the vacuum cleaner. The battery compartment is located beneath the dust collection chamber 18 when the elongate body 12 is in its vertical, parked position, which helps to balance out the weight of the motor and fan in the region of reference numeral 20 and to lower the centre of gravity of the vacuum cleaner. Moreover, the battery compartment 34 is also located in front of the changeover valve 22, lying across the plane which contains the flow of dirty air from the inlet 140 of the floorhead 14, through the changeover valve 22 and the duct 28 to the inlet 180 of the dust collection chamber 18, and is inside a curve defined by the flow of dirty air from the inlet 140 through the changeover valve 22 to the duct 28. Thus the battery compartment 34 does not interfere with the flow of dirty air from the inlet 140 to the dust collection chamber 18. As may be seen in FIG. 3, the battery compartment 34 is oriented at an oblique angle to a longitudinal axis of the elongate body 12 of the vacuum cleaner, so that a battery having a handle located at one end thereof may be inserted into the battery compartment 34 in the direction indicated in FIG. 3 by arrow A and removed therefrom in a direction opposite to arrow A by a user grasping the handle of the battery. Thus the battery may be removed from the vacuum cleaner by the user, for example for recharging, and then replaced, with very little effort.

Figure 4:
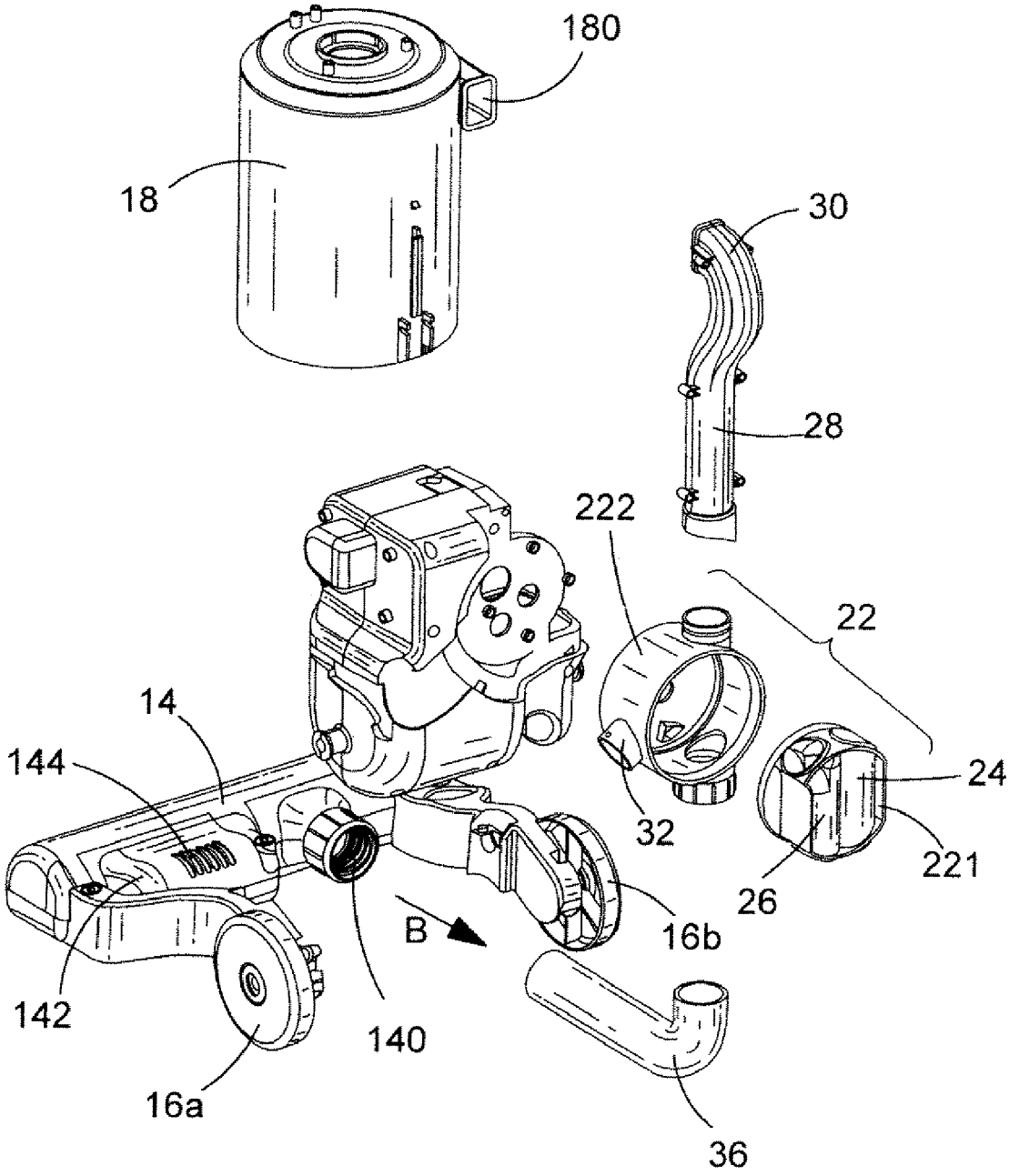
FIG. 4 is a rear exploded perspective view of the vacuum cleaner of FIG. 2 shown in a substantially vertical, parked position.

FIG. 4 shows an exploded view of the vacuum cleaner 10 seen from above, the rear and one side. This view again shows the inlet 180 of dust collection chamber 18 and the shape of sigmoid curve 30 of duct 28 more clearly. FIG. 4 also shows, however, that linear conduit 24 and J-shaped conduit 26 are integrally moulded into an insert component 221 of the changeover valve 22, which is contained within a housing 222 of the changeover valve 22. Thus insert component 221 is free to rotate within housing 222, by which means the flow of dirty air through the changeover valve 22 may be switched from the dirty air inlet 140 of floorhead 14 to the outlet 32 of the wand. Dirty air inlet 140 may also be seen most clearly, from which dirty air is expelled during operation of the vacuum cleaner in the direction indicated in FIG. 4 by arrow B, towards pivot joint 36, which connects floorhead 14 in fluid flow with changeover valve 22. In the illustrated embodiment, the pivot joint 36 is composed of a plurality of rigid components arranged to move between a first position, in which they adopt a substantially right-angled configuration as shown in FIG. 4, which corresponds to the vertical, parked position of the elongate body 12, and a second position, in which they adopt a smoothly curving configuration corresponding to the tilted, use position of the elongate body 12.

Figure 5:
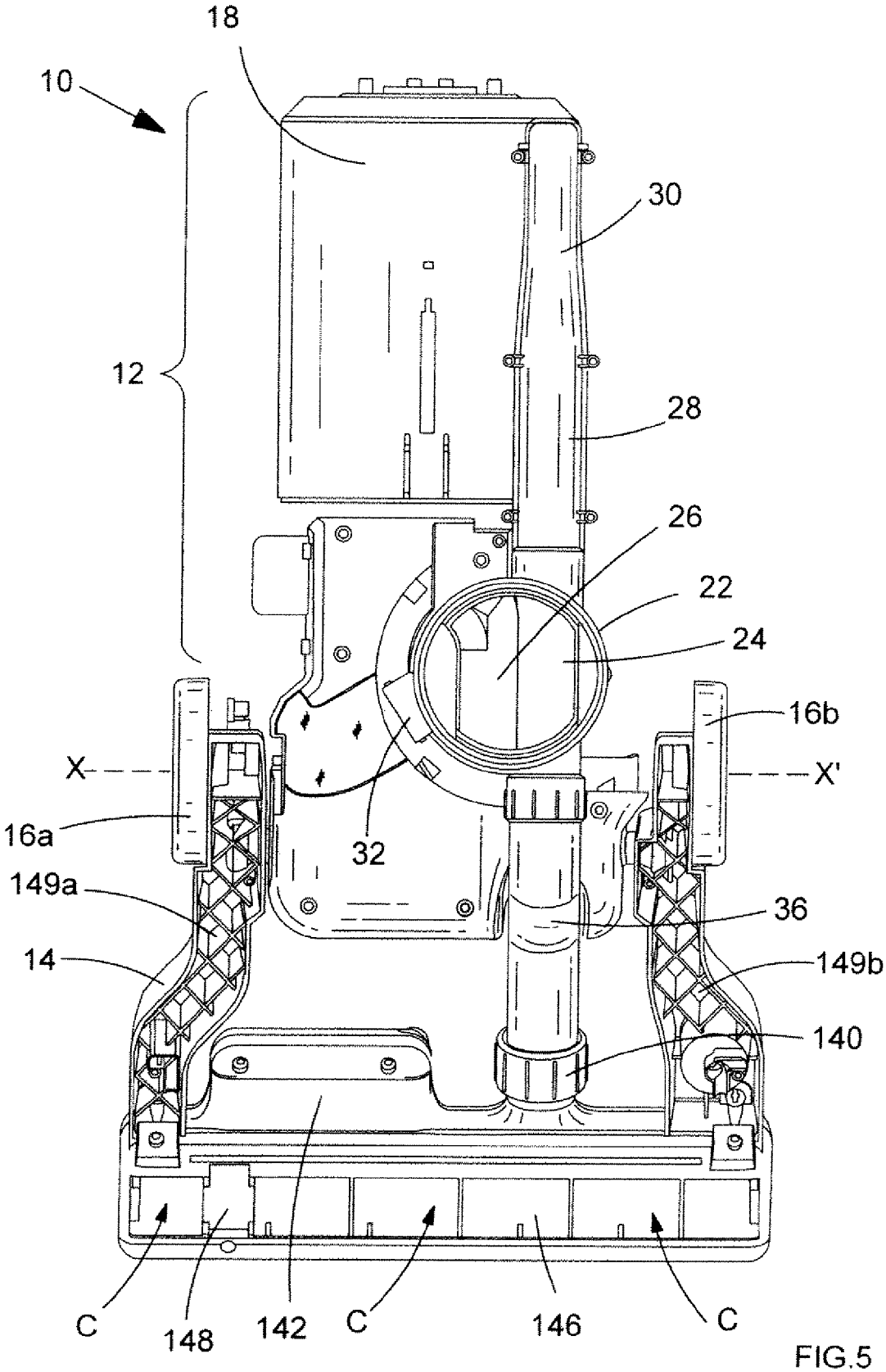
FIG. 5 is a rear elevational view of the vacuum cleaner of FIG. 2, shown in a tilted, use position.

FIG. 5 should be compared with FIG. 2, being a similar view thereto, except that the elongate body 12 of the vacuum cleaner is now in its tilted, use position in FIG. 5. FIG. 5 shows very clearly how the flow of dirty air from the inlet 140 of the floorhead 14, through the linear conduit 24 of changeover valve 22 and duct 28 to the inlet 180 of the dust collection chamber 18 all lies in one plane, perpendicular to the plane of the page. FIG. 5 also shows a mouth 146 of floorhead 14, whereby dirty air enters inlet 140 in the direction indicated in FIG. 5 by arrows labelled C. The rotatable brush mentioned earlier for increasing the pick-up ratio of the vacuum cleaner is also contained within mouth 146 and is driven to rotate by the auxiliary motor in compartment 142 via a drive belt housed within chamber 148. Finally, FIG. 5 shows how floorhead 14 has two side arms 149*a*, 149*b* connecting mouth 146 with wheels 16*a*, 16*b* and the pivot axis X-X' about which pivot joint 36 and the whole vacuum cleaner rotates in order to switch from its vertical, parked position to its tilted, use position.

Figure 6:
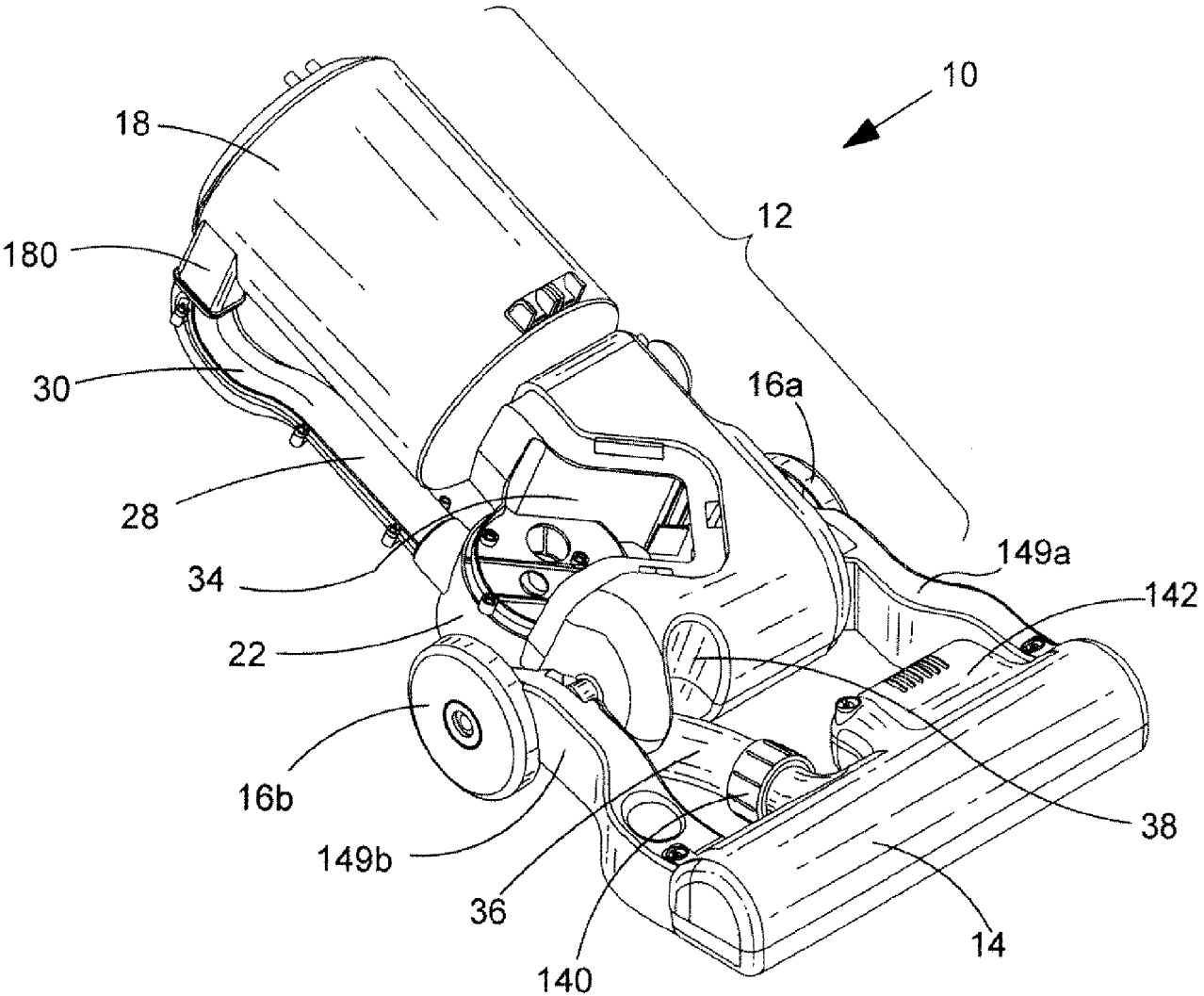
FIG. 6 is a front perspective view from above, in front and one side of the vacuum cleaner of FIG. 2, shown in the tilted, use position.

FIG. 6 shows the same vacuum cleaner in a perspective view from above, in front and one side, once again in its tilted, use position. This again clearly shows the obliquely angled battery compartment 34, but also reveals how elongate body 12 is provided with a recess 38 to accommodate pivot joint 36. This ensures that the airflow pathway form floorhead 14 to changeover valve 22 does not have to bend sharply in order to connect dirty air inlet 140 with linear conduit 24, but rather, may curve smoothly through recess 38.

Figure 7:
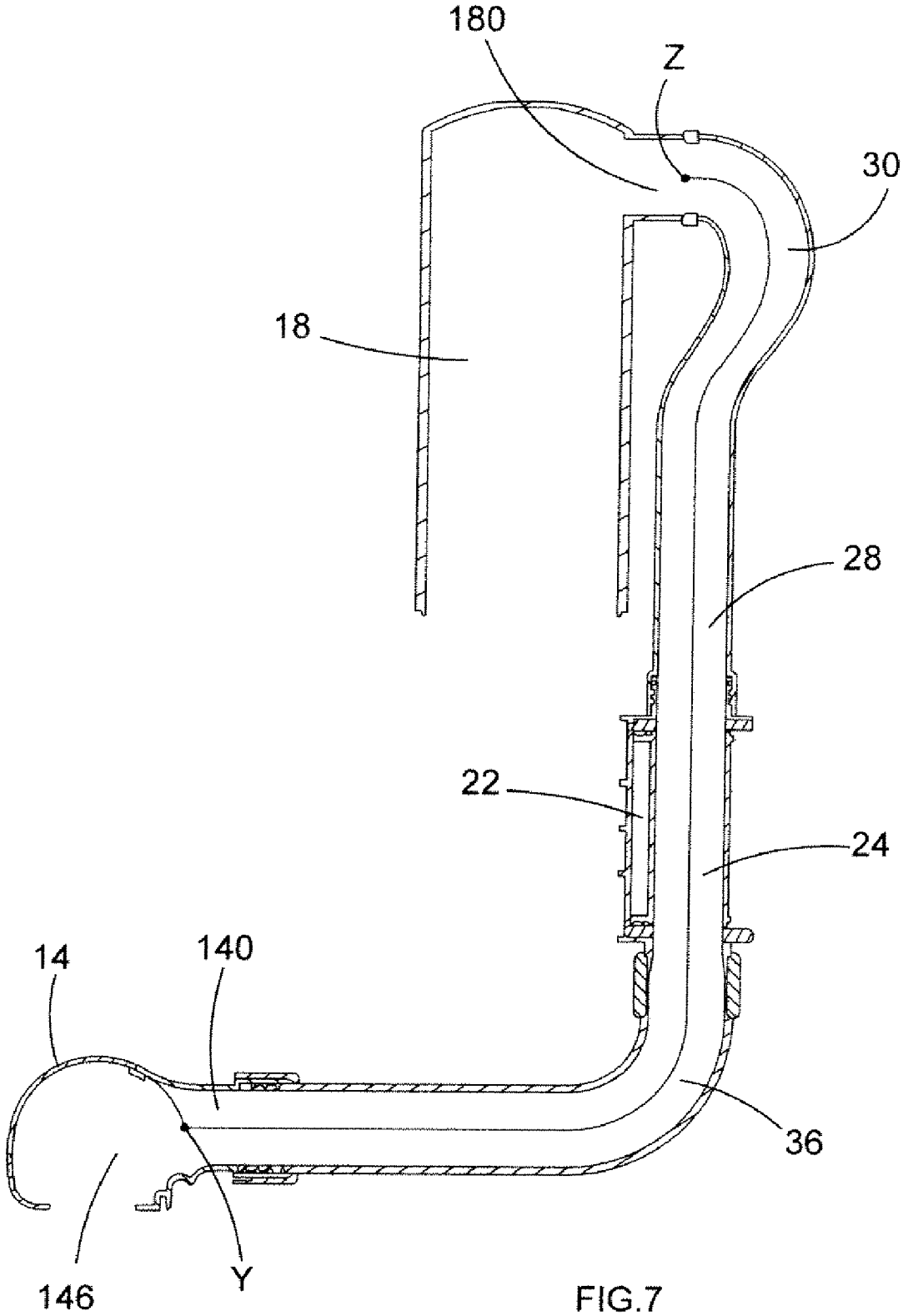
FIG. 7 is a planar, longitudinal sectional view of the airflow pathway of the vacuum cleaner of FIG. 2 in the substantially vertical, parked position.
Figure 8:
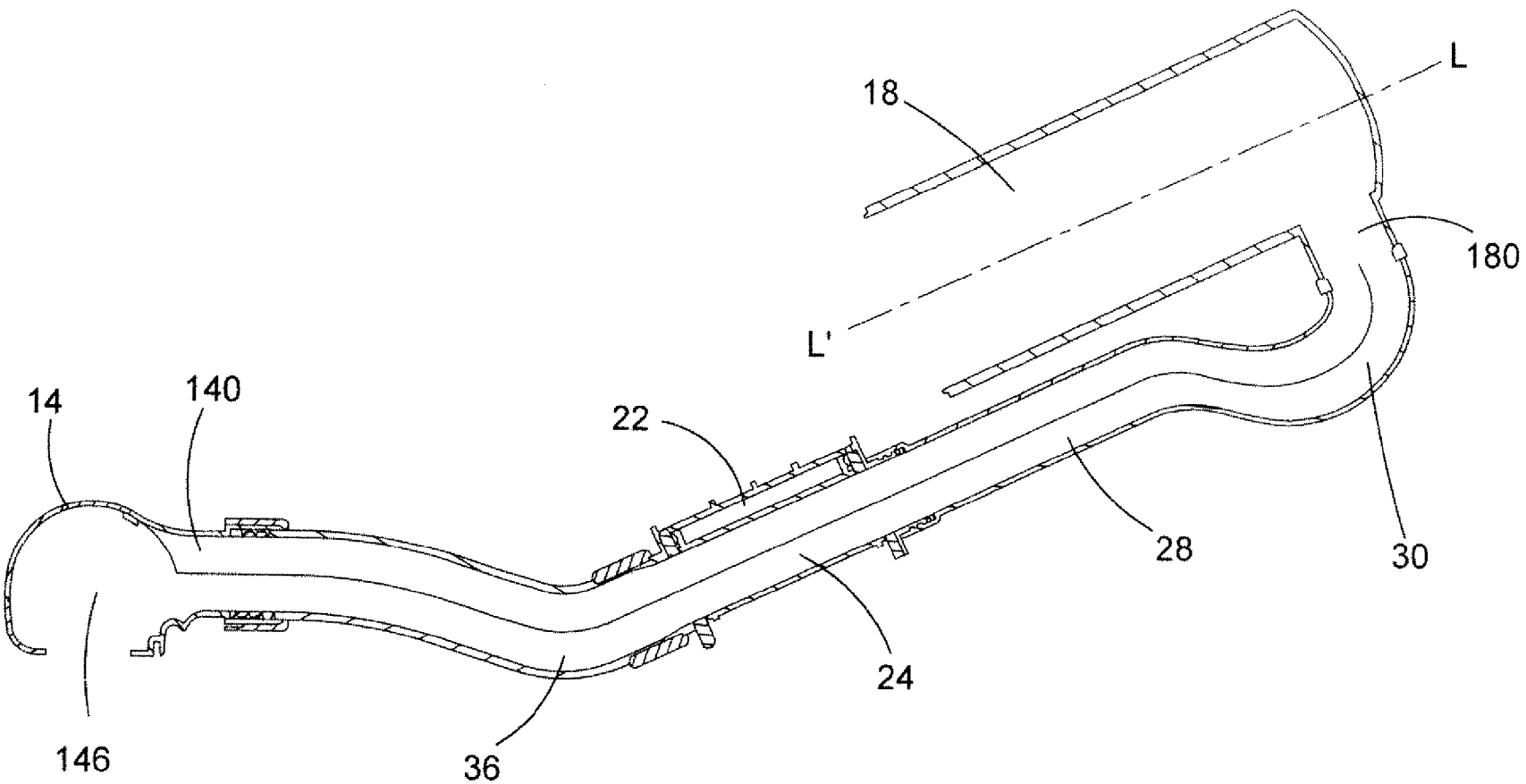
FIG. 8 is a planar, longitudinal sectional view of the airflow pathway of the vacuum cleaner of FIG. 2 in the tilted, use position.

FIG. 7 is a longitudinal sectional view of the airflow pathway of the vacuum cleaner 10 in its substantially vertical, parked position. The overall length of the airflow pathway is measured from where dirty air inlet 140 intersects mouth 146 of floorhead 14 at the point indicated in FIG. 7 by Y to where the sigmoid curve 30 of duct 28 intersects inlet 180 of dust collection chamber 18 at the point indicated in FIG. 7 by Z. FIG. 8 is a corresponding view to FIG. 7, except that the vacuum cleaner 10 is now in its tilted, use position. FIG. 8 also shows the longitudinal axis L-L' of the elongate body of the vacuum cleaner. By comparing FIG. 8 with FIG. 7, it can be seen that the overall length of the airflow pathway from point Y to point Z shrinks when the vacuum cleaner is pivoted from its vertical, parked position to its tilted, use position, due to the contraction of pivot joint 36. In this embodiment, the airflow pathway has an overall length of 703 mm when the elongate body 12 of the vacuum cleaner 10 is in its substantially vertical, parked position and of 646 mm when the elongate body 12 of the vacuum cleaner 10 is tilted at an angle of 65 degrees to the vertical, i.e. of 25 degrees to the horizontal. Therefore, the overall length of the airflow pathway enjoys a contraction of approximately 8% during use.

Figure 9:
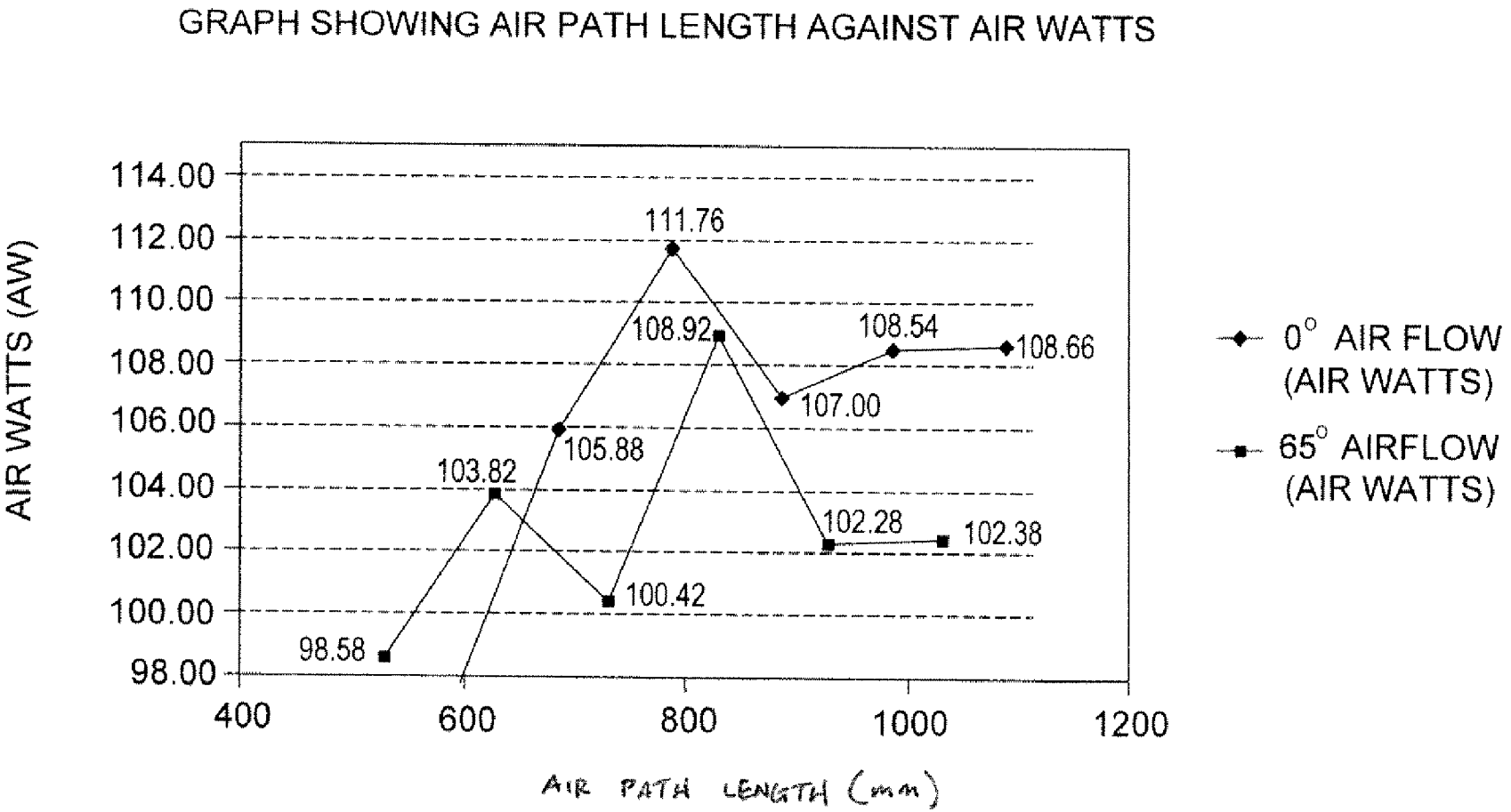
FIG. 9 is a graph plotting the peak air watts versus the overall length of an airflow pathway.

FIG. 9 is a graph showing the performance of a test rig set up according to the invention. The test rig comprised a floorhead 14 having a dirty air inlet 140, a pivot joint 36 comprising a flexible hose, a changeover valve 22 comprising a linear conduit 24, a duct 28 having a sigmoid curve 30, and a dust collection chamber 18 having a dirty air inlet 180, all arranged to form an airflow pathway, such that when the conduit 24 is positioned in fluid flow between the inlet 140 and the duct 28, a flow of air from the inlet 140 of the floorhead 14, through the changeover valve 22 and duct 28 to the inlet 180 of the dust collection chamber 18 all lies in a plane. However, the overall length of the airflow pathway in this test rig can also be varied at 100 mm intervals and the peak air watts measured accordingly, as represented in FIG. 9. Moreover, the test rig can also be pivoted between a first position, similar to that shown in FIG. 7, in which the pivot joint directs the airflow through a right-angled bend, corresponding to a vertical, parked position of a vacuum cleaner which the test rig represents, and a second position, similar to that shown in FIG. 8, in which the pivot joint directs the airflow through an angle of 65 degrees from the vertical, 25 degrees from the horizontal, corresponding to a tilted, use position of the vacuum cleaner which the test rig represents. At the least extension of the test rig, with the pivot joint in the position of a right-angled bend (as in FIG. 7), the overall length of the airflow pathway was measured to be 586 mm, and at the greatest extension thereof, with the pivot joint in the same position, the overall length of the airflow pathway was measured to be 1086 mm. With the pivot joint instead in the position of FIG. 8, at the least extension of the test rig, the overall length of the airflow pathway was reduced to 529 mm due to the contraction of the flexible hose of the pivot joint, and with the pivot joint still in the same position, at the greatest extension of the test rig, the overall length of the airflow pathway was reduced to 1029 mm, again due to the contraction of the flexible hose.

In the graph of FIG. 9, data points represented by diamonds indicate the peak air watts of the test rig measured with the pivot joint in the position of FIG. 7 and those represented by boxes indicate the peak air watts of the test rig measured with the pivot joint in the position of FIG. 8. As can be seen from FIG. 9, the maximum value of the peak air watts is achieved at an overall length of the airflow pathway of about 800 mm, after which the air watts start to plateau. It can also be seen that the value of the peak air watts of the test rig in the position of FIG. 8 is generally less than that of the same test rig in the position of FIG. 7. This is thought to be because of the effects on the airflow pathway of the contraction of the flexible hose of the pivot joint, as described previously above, namely that the flexible hose is made both narrower and less smooth when it contracts than when it is extended, which combine to have the effect of constricting the flow of air therethrough. Consequently, the length of the flexible hose should preferably comprise no more than about 20% of the overall length of the airflow pathway in either its extended or contracted states.

Figure 10:
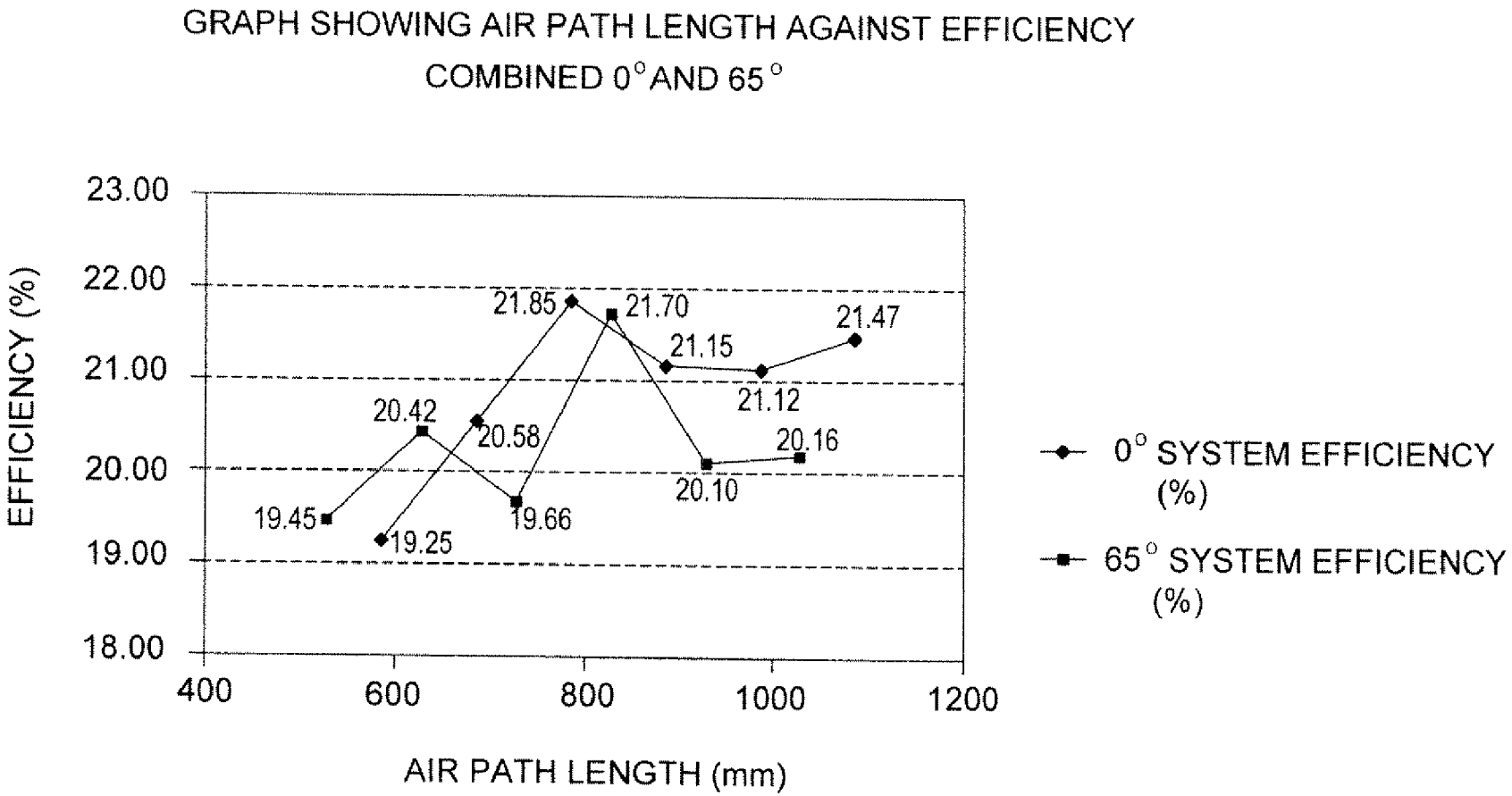
FIG. 10 is a graph plotting the overall system efficiency versus the overall length of the airflow pathway.

FIG. 10 is a similar graph to FIG. 9 and relates to the same test rig placed in the same two positions, as again indicated by the data points respectively represented in FIG. 10 by diamonds and boxes. In FIG. 10, the values of the peak air watts of the test rig as measured in FIG. 9 have been divided by the actual values of electrical power which were measured as being input to a motor driving a fan attached to the test rig in order to generate a flow of air therethrough, thereby giving data points in the graph of FIG. 10 which represent the actual overall efficiency of the system comprising the motor and fan and the test rig. In the measurements that were performed, the motor used to drive the fan for generating a flow of air through the test rig was an AC motor supplied with mains electrical power. However, in a vacuum cleaner according to the invention, such an AC motor should advantageously be replaced with a higher efficiency DC motor supplied with electrical power from a battery. Thus, the overall system efficiency measured with the test rig to be in the range of about 19 to 22% could be improved with such a motor to be 40% or greater, which is an excellent result for an upright vacuum cleaner, giving either greatly increased run time or a smaller, lighter battery, increased air watts or any combination of these, according to the choice of the designer. Thus, the present invention is able to provide an upright vacuum cleaner with improved efficiency, which is particularly suitable for use with battery power.

The invention claimed is:

1. An upright vacuum cleaner (10) having an elongate body (12) and comprising: a floorhead (14) on which said elongate body is mounted, having a first inlet (140) for dirty air;

a wand having a second inlet for dirty air;

a changeover valve (22) for selecting between a flow of dirty air from a respective one of said first or second inlets;

a dust collection chamber (18) having a dirty air inlet (180);

a duct (28) for conveying said flow of dirty air from the changeover valve (22) to the dust collection chamber (18); and a source of suction power for drawing said flow of dirty air from the first or second inlet, through said changeover valve (22) and said duct (28) to the dust collection chamber (18);

the changeover valve (22) having a linear conduit (24) positionable in fluid flow between the first inlet (140) and said duct (28);

the duct (28) being shaped as a sigmoid curve (30) as it enters the dust collection chamber inlet (180); and when said conduit (24) is positioned in fluid flow between said first inlet (140) and said duct (28), the flow of dirty air from said first inlet (140) through said changeover valve (22) and said duct (28) to the dust collection chamber inlet (180) all lies in the same plane.

2. A vacuum cleaner according to claim 1, wherein the dust collection chamber (18) comprises a cyclonic separation device and said plane is tangential to an outer surface of said cyclonic separation device.

3. A vacuum cleaner according to claim 1, wherein the source of suction power comprises a motor and a fan located above said dust collection chamber (18) when said elongate body (12) is pivoted to a substantially vertical position.

4. A vacuum cleaner according to claim 3, further comprising a compartment (34) for receiving a battery for supplying electrical power to said motor, said battery compartment being located beneath said dust collection chamber (18) when said elongate body (12) is pivoted to a substantially vertical position.

5. A vacuum cleaner according to claim 4, wherein the battery compartment (34) is located fore or aft of said changeover valve (22), lying across said plane containing the flow of dirty air from the first inlet (140) through said changeover valve (22) and said duct to the dust collection chamber (18).

6. A vacuum cleaner according to claim 5, wherein the battery compartment (34) is located in front of said changeover valve (22), inside a curve defined by the flow of dirty air from the inlet (140) of the floorhead (14) through the changeover valve (22) to the duct (28).

7. A vacuum cleaner according to claim 4, wherein the battery compartment (34) is oriented at an oblique angle to a longitudinal axis ($L$-$L^1$) of said elongate body (12).

8. A vacuum cleaner according to claim 1, wherein the changeover valve (22) further comprises a J-shaped conduit (26) positionable in fluid flow between the second inlet for dirty air of said wand and said duct (28).

9. A vacuum cleaner according to claim 1, wherein an overall length (Y-Z) of the airflow pathway from the first inlet (140) for dirty air of the floorhead (14) to the dust collection chamber inlet (180), when the linear conduit (24) of said changeover valve (22) is positioned in fluid flow between said first inlet (140) and said duct (28), lies in the range of between 600 mm and 1000 mm.

10. A vacuum cleaner according to claim 9, wherein the overall length (Y-Z) of the airflow pathway from the first inlet (140) to the dust collection chamber inlet (180), when the linear conduit (24) of said changeover valve (22) is positioned in fluid flow between said first inlet (140) and said duct (28), lies in the range of between 600 mm and 800 mm.

11. A vacuum cleaner according to claim 1 further comprising a pivot joint (36) located in fluid flow between the first inlet (140) for dirty air of the floorhead (14) and the changeover valve (22), wherein the pivot joint (36) comprises a flexible hose comprising no more than 20% of the overall length of the airflow pathway from the first inlet (140) for dirty air of the floorhead (14) to the inlet (180) of the dust collection chamber (18).

12. A vacuum cleaner according to claim 1, wherein the dirty air inlet is located at a top portion of the dust collection chamber.

* * * * *